US009303572B2

(12) United States Patent
Kawakami et al.

(10) Patent No.: US 9,303,572 B2
(45) Date of Patent: Apr. 5, 2016

(54) SENSOR SIGNAL PROCESSING DEVICE

(71) Applicant: DENSO CORPORATION, Kariya, Aichi-pref. (JP)

(72) Inventors: Daisuke Kawakami, Anjo (JP); Akito Itou, Kariya (JP); Ryotaro Kuno, Ichinomiya (JP)

(73) Assignee: DENSO CORPORATION, Kariya (JP)

( * ) Notice: Subject to any disclaimer, the term of this patent is extended or adjusted under 35 U.S.C. 154(b) by 571 days.

(21) Appl. No.: 13/737,379

(22) Filed: Jan. 9, 2013

(65) Prior Publication Data

US 2013/0179052 A1 Jul. 11, 2013

(30) Foreign Application Priority Data

Jan. 11, 2012 (JP) ..... 2012-003010

(51) Int. Cl.

*F02D 37/02* (2006.01)
*F02D 35/02* (2006.01)
*F02P 5/152* (2006.01)
(Continued)

(52) U.S. Cl.

CPC ..... *F02D 35/027* (2013.01); *F02D 37/02* (2013.01); *F02P 5/152* (2013.01); *F02D 35/023* (2013.01); *F02D 2041/1432* (2013.01); *F02D 2041/281* (2013.01); *F02D 2041/286* (2013.01); *F02P 5/1522* (2013.01)

(58) Field of Classification Search

CPC . F02D 35/027; F02D 2041/281; F02D 37/02; F02D 2041/286; F02D 2041/288; F02D 35/023; F02D 2041/1432; F02P 5/152; F02P 17/12; F02P 2017/128; F02P 5/1522; G01L 23/225

USPC ..... 701/111, 114, 115, 102; 123/478, 123/406.37, 406.38, 406.39; 73/35.04, 73/35.12

See application file for complete search history.

(56) References Cited

U.S. PATENT DOCUMENTS 4,711,212 A * 12/1987 Haraguchi et al. ..... 123/406.38
4,800,500 A * 1/1989 Tanaka ..... 701/111
(Continued)

FOREIGN PATENT DOCUMENTS

JP 1-318744 12/1989
JP 4-370349 12/1992
(Continued)

OTHER PUBLICATIONS

Office Action (3 pgs.) issued Dec. 17, 2013 in corresponding Japanese Application No. 2012-003010 with an at least partial English-language translation thereof (3 pgs.).

*Primary Examiner* — Joseph Dallo
(74) *Attorney, Agent, or Firm* — Nixon & Vanderhye PC

(57) ABSTRACT

A microcomputer is formed of a CPU and a detection circuit and inputs sensor signals of a vibration sensor and a rotation sensor. The detection circuit includes an AD converter circuit for AD conversion of the sensor signal of the vibration sensor at a predetermined sampling interval, a peak hold circuit for detecting a peak value of the sensor signal, a RAM for storing the peak value, a counter for detecting a crank angle at a peak value detection time, and an angle calculation part. The microcomputer divides a pre-ignition check interval into plural interval units and checks the pre-ignition based on the peak value detected in each unit interval. The pre-ignition and the knock are checked by using different threshold values in an interval, in which the pre-ignition check interval overlaps a knock check interval.

21 Claims, 4 Drawing Sheets

(51) Int. Cl.
*F02D 41/14* (2006.01)
*F02D 41/28* (2006.01)

(56) References Cited

U.S. PATENT DOCUMENTS

| | | | | | |
|---|---|---|---|---|---|
| 4,884,206 | A | * | 11/1989 | Mate | 701/111 |
| 4,993,387 | A | * | 2/1991 | Sakakibara et al. | 123/406.33 |
| 5,060,615 | A | * | 10/1991 | Hashimoto et al. | 123/406.16 |
| 5,109,820 | A | * | 5/1992 | Iwata et al. | 123/406.37 |
| 5,121,729 | A | * | 6/1992 | Hashimoto et al. | 123/406.16 |
| 5,188,080 | A | * | 2/1993 | Sakakibara et al. | 123/406.38 |
| 5,190,011 | A | * | 3/1993 | Hashimoto et al. | 123/406.38 |
| 5,276,625 | A | * | 1/1994 | Nakaniwa | 701/111 |
| 5,355,853 | A | * | 10/1994 | Yamada et al. | 123/406.38 |
| 5,361,213 | A | * | 11/1994 | Fujieda et al. | 701/111 |
| 5,388,560 | A | * | 2/1995 | Hisaki et al. | 123/406.14 |
| 5,411,000 | A | * | 5/1995 | Miyashita et al. | 123/406.35 |
| 5,421,304 | A | * | 6/1995 | Gibtner et al. | 123/406.39 |
| 5,426,587 | A | * | 6/1995 | Imai et al. | 701/111 |
| 5,632,247 | A | | 5/1997 | Hashizume et al. | |
| 5,740,780 | A | * | 4/1998 | Shimizu et al. | 123/406.22 |
| 5,751,147 | A | * | 5/1998 | Nakata et al. | 324/399 |
| 5,755,206 | A | * | 5/1998 | Takahashi et al. | 123/406.37 |
| 5,905,193 | A | * | 5/1999 | Hashizume et al. | 73/35.09 |
| 5,991,686 | A | | 11/1999 | Oguro et al. | |
| 6,173,691 | B1 | * | 1/2001 | Yanagihara | 123/299 |
| 6,386,183 | B1 | * | 5/2002 | Lodise et al. | 123/406.21 |
| 7,302,932 | B2 | * | 12/2007 | Shelby et al. | 123/406.26 |
| 7,480,557 | B2 | * | 1/2009 | Yamaguchi et al. | 701/104 |
| 7,861,689 | B2 | * | 1/2011 | Haug et al. | 123/406.21 |
| 8,073,613 | B2 | * | 12/2011 | Rollinger et al. | 701/111 |
| 8,260,530 | B2 | * | 9/2012 | Rollinger et al. | 701/111 |
| 8,316,824 | B2 | * | 11/2012 | Hagari et al. | 123/406.29 |
| 2002/0007818 | A1 | * | 1/2002 | Lodise et al. | 123/406.29 |
| 2003/0127071 | A1 | * | 7/2003 | Sauler et al. | 123/406.29 |
| 2007/0067090 | A1 | * | 3/2007 | Hashimoto et al. | 701/111 |
| 2008/0022976 | A1 | * | 1/2008 | Morimoto et al. | 123/478 |
| 2008/0078359 | A1 | * | 4/2008 | Barrett et al. | 123/406.37 |
| 2009/0043484 | A1 | * | 2/2009 | Yoshihara et al. | 701/111 |
| 2009/0078234 | A1 | * | 3/2009 | Barrett et al. | 123/406.37 |
| 2009/0288476 | A1 | * | 11/2009 | Buganza et al. | 73/35.05 |
| 2010/0106392 | A1 | * | 4/2010 | Charrier et al. | 701/111 |
| 2011/0093186 | A1 | | 4/2011 | Hagari et al. | |
| 2011/0224882 | A1 | * | 9/2011 | Makino et al. | 701/102 |
| 2012/0192833 | A1 | * | 8/2012 | Hagari et al. | 123/406.35 |
| 2012/0192835 | A1 | * | 8/2012 | Matsushima et al. | 123/436 |

FOREIGN PATENT DOCUMENTS

| | | |
|---|---|---|
| JP | 9-126106 | 5/1997 |
| JP | 2002-161802 | 6/2002 |
| JP | 2005-127242 | 5/2005 |
| JP | 2007-107506 | 4/2007 |
| JP | 2008-232034 | 10/2008 |

* cited by examiner

ABNORMAL VIBRATION DETECTION

SENSOR SIGNAL PROCESSING DEVICE

CROSS REFERENCE TO RELATED APPLICATION

The present application is based on and incorporates herein by reference Japanese patent application No. 2012-3010 filed on Jan. 11, 2012.

TECHNICAL FIELD

The present disclosure relates to a sensor signal processing device for an engine.

BACKGROUND ART

As one abnormal combustion condition among various combustion conditions of an engine, air-fuel mixture is ignited by itself for some reason without ignition spark in the midst of compression stroke of the engine. This is referred to as a pre-ignition. The pre-ignition causes malfunction in engine output power or engine rotation.

It is thus necessary to control the engine by detecting such a pre-ignition. The pre-ignition may be detected generally by comparing an ignition timing and an abnormal vibration generation timing. For this detection, the abnormal vibration generation timing need be detected accurately. The pre-ignition varies its magnitude very much and frequently occurs at the same time as an engine knock. To differentiate the pre-ignition and the knock, it is necessary to detect accurately both of the magnitude and the generation timing of the pre-ignition.

JP H08-319931A, which corresponds to U.S. Pat. No. 5,632,247, discloses one example of detection of a pre-ignition by comparison of an ignition timing and an abnormal vibration generation timing. Specifically, a microcomputer (signal processing device) generates a sensor value acquisition request at every predetermined time interval and an analog-digital converter (AD converter) performs AD conversion in response to the sensor value acquisition request. The microcomputer checks whether an AD-converted sensor value exceeds a threshold value thereby to check whether an abnormal vibration is generated. The microcomputer checks whether a pre-ignition is present by comparison of the generation timing of the abnormal vibration and the ignition timing.

According to this detection method, the AD converter performs the AD conversion period in response to the request from the microcomputer. The microcomputer determines the pre-ignition when the AD-converted sensor value is higher than the threshold value and the abnormal vibration generation timing and the ignition timing are within a fixed crankshaft rotation angular interval. For accurately detecting the sensor value of the pre-ignition vibration frequency in a range of 5 kHz to 25 kHz, a sampling frequency of about 100 kHz is needed. Thus, the above-described processing need be finished within a interval of 10 microseconds (μs) and hence the microcomputer must be capable of high speed data processing.

For reducing the processing load or shortening the processing time, a pre-ignition detection interval and a knock detection interval are differentiated. However this detection method makes it impossible to detect the pre-ignition, when the pre-ignition is generated near the knock generation timing.

SUMMARY

It is therefore an object to provide a sensor signal processing device, which is capable of reducing a signal processing load and detecting surely a pre-ignition even in a knock detection interval.

According to one aspect, a sensor signal processing device includes an AD conversion part, a pre-ignition check interval setting part, a crank angular interval setting part, a time measuring part, a peak value detection part, a crank angle calculation part and a memory part.

The AD conversion part converts an analog sensor signal outputted from a sensor, which detects a combustion condition in a cylinder of an engine, into a digital signal. The pre-ignition check interval setting part sets a pre-ignition check interval in synchronism with a crank angle indicated by a rotation sensor signal, which varies with a rotation of a crankshaft of the engine. The crank angular interval setting part sets a plurality of crank angular intervals by dividing the pre-ignition check interval. The time measuring part measures elapse time in the plurality of crank angular intervals. The peak value detection part detects a peak value of the digital signal outputted from the AD conversion part in each of the plurality of crank angular intervals. The crank angle calculation part calculates a peak value detection crank angle, at which the peak value is detected in each of the plurality of crank angular intervals, based on the elapse time measured by the time measuring part until the peak value is detected by the peak value detection part. The memory part stores the peak value detected by the peak value detection part and the peak value detection crank angle calculated by the crank angle calculation part.

BRIEF DESCRIPTION OF THE DRAWINGS

The above and other objects, features and advantages of a signal processing device will become more apparent from the following description made with reference to the accompanying drawings. In the drawings.

DETAILED DESCRIPTION OF THE EMBODIMENT

Figure 1:
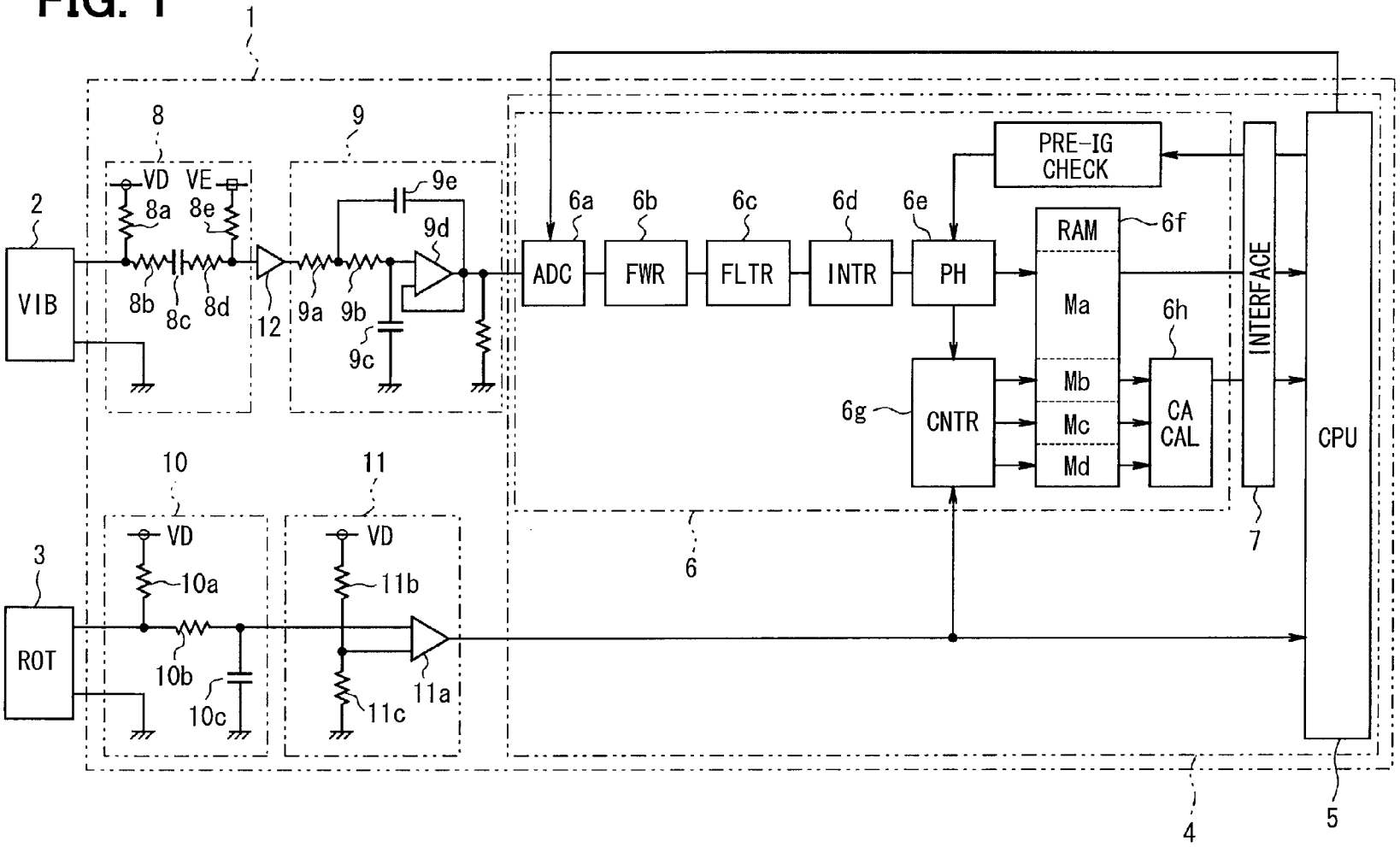
FIG. 1 is an electric circuit diagram showing an entire configuration of one embodiment of a sensor signal processing device.

Referring to FIG. 1, a sensor signal processing device is implemented as an electronic control unit (ECU) 1, which receives signals from a vibration sensor 2 mounted on an engine (not shown) and a rotation sensor 3 for detecting a crankshaft rotation position (rotation angle).

The ECU 1 is formed of mainly a microcomputer (referred to as a computer) 4, which is a one-chip microcomputer formed as a semiconductor device including a CPU 5, a detection circuit 6 and a communication interface circuit 7 integrally. The CPU 5 is configured to communicate signals with the detection circuit 6 through the communication interface circuit 7. The CPU 5 has functions of operating as a check interval setting part, a crank angle interval setting part, a pre-ignition check part and a monitor part as described below. The ECU 1 includes a vibration sensor input circuit 8 and a filter circuit 9 for retrieving a detection signal of the vibration sensor 2 into the computer 4. The ECU 1 also includes a rotation sensor input circuit 10 and a waveform shaper circuit 11 for retrieving a detection signal of the rotation sensor 3 into the computer 4.

The vibration sensor 2 detects vibrations of engine cylinders to output the detection signal, which is inputted to the vibration sensor input circuit 8. The vibration sensor input circuit 8 has an input terminal connected to a first power supply terminal VD through a phase-fixing resistor 8*a*, and an output terminal through a series circuit, which is formed of a resistor 8*b*, a D.C. cut-off capacitor 8*c* and a resistor 8*d*. The output terminal is connected to a second power supply terminal VE through a resistor 8*e*. The vibration sensor input circuit 8 subjects the detection signal of the vibration sensor 2 to D.C. component cut-off and differentiation to output a differentiated signal, which corresponds to a voltage level of the second power supply terminal VE. The voltage at the first power supply terminal VD is set to 5V, for example, and the voltage at the second power supply terminal VE is set to about 2.5V, for example.

The output signal of the vibration sensor input circuit 8 is applied to the filter circuit 9. The filter circuit 9 has a function of an anti-aliasing filter, which removes folding noises generated at the time of AD conversion (AD conversion time). The filter circuit 9 is formed of a low-pass filter, which includes resistors 9*a*, 9*b* and a capacitor 9*c*, an operational amplifier 9*d* and the like. The filter circuit 9 is configured to cut off frequency components of higher than a predetermined frequency before the AD conversion processing performed by the detection circuit 6.

The rotation sensor 3 outputs a rotation signal of the crankshaft rotation angle (crank angle CA) of the engine, which is inputted to the rotation sensor input circuit 10. The rotation sensor input circuit 10 has an input terminal connected to the first power supply terminal VD through a phase-fixing resistor 10*a*. The rotation sensor input circuit 10 includes a low-pass filter formed of a resistor 10*b* and a capacitor 10*c*. The rotation sensor input circuit 10 thus removes noises by cutting off high frequency components of higher than a predetermined frequency and outputs the filtered signal to the waveform shaper circuit 11.

The waveform shaper circuit 11 includes a comparator 11*a* and a voltage divider circuit formed of resistors 11*b* and 11*c*. The comparator 11*a* compares an output signal level of the rotation sensor input circuit 10 and a set voltage of the voltage divider circuit, and outputs a high level signal when the output signal level of the rotation sensor input circuit 10 becomes equal to or higher than the set voltage. Thus, the output signal level is converted into a signal waveform synchronized with the crank angle. The waveform shaper circuit 11 inputs the signal synchronized with the crank angle to the detection circuit 6 and the CPU 5, which forms the monitor part.

In the detection circuit 6 of the computer 4, an AD conversion circuit (ADC) 6*a* forming an AD conversion part converts the output signal of the filter circuit 9 into a digital signal at a predetermined sampling interval (for example, at every 10 μs). A digital signal produced by the AD conversion is inputted to a full-wave rectifier circuit 6*b* provided as a rectification part. The sampling frequency of the AD conversion circuit 6*a* is variably set by the CPU 5 such that it is set to an arbitrary sampling interval by a computer program or external instruction. The full-wave rectifier circuit 6*b* full-wave rectifies the digital signal having positive and negative values, that is, converts the same into absolute values, and outputs it to a digital filter 6*c*.

The digital filter 6*c* limits a frequency band and outputs a filtered output to a peak hold circuit 6*e*, which is provided as a peak value detection part, through an integration circuit 6*d*. The integration circuit 6*d* cuts off signals, which have sporadic peaks superimposed on the output signal of the vibration sensor 2, to further reduce influence of noises, and outputs vibration components, which are generated repetitively, to the peak hold circuit 6*e*. The peak hold circuit 6*e* holds a peak value in a pre-ignition check interval determined as a time period by the CPU 5 and outputs a peak value data to a RAM 6*f* and a counter circuit 6*g* provided as a time measuring part.

The RAM 6*f* has four memory areas Ma to Md and stores by over-writing the peak value data inputted from the peak hold circuit 6*e* in the memory area Ma (initial value 0). The memory areas Mb, Mc and Md of the RAM 6*f* are for storing data indicative of a counter value corresponding to a time t of peak hold operation, a counter value corresponding to a time interval T of the rotation sensor 3 and the crank angle of each falling edge of the output signal of the rotation sensor 3.

The counter circuit 6*g* receives the output signal of the waveform shaper circuit 11, that is, the crank angle signal produced from the rotation sensor 3. The counter circuit 6*g* starts counting time at a time of falling edge of the crank angle signal waveform and resets its counter value at a time of next falling edge of the crank angle signal waveform. By thus executing the program at every 1 μs interval and incrementing the counter value, the time measurement is started at the time of falling edge of the crank angle signal. This time measurement is reset at the time of next falling edge of the crank angle and a new time measurement is started.

The counter circuit 6*g* measures a time interval of the crank angle signal produced from the rotation sensor 3 and stores the measured interval in the memory area Mc of the RAM 6*f*. In the second and the subsequent times, the counter circuit 6*g* overwrites the measured data when the peak-hold is made in the present pulse (overwriting is made in the memory area Ma of the RAM 6*f*).

The counter circuit 6*g* stores in the memory area Mb of the RAM 6*f* the counter value, which indicates the time of storing the peak value from the peak hold circuit 6*a* to the memory area Ma of the RAM 6*f*. In this case, the counter circuit 6*g* overwrites in the memory area Mb of the RAM 6*f* each time the peak value is stored. The memory area Md of the RAM 6*f* is updated at every start of the output signal of the rotation sensor 3 (every falling edge time) and increments the crank angle of one angular interval (for example, 10° CA).

An angle calculation part 6*h* retrieves a peak value of the detection signal of the vibration sensor 2 from the memory area Ma of the RAM 6*f*, retrieves the crank angle data at the peak detection time from the memory areas Mb to Md, and calculates a crank angle (peak detection angle), at which the peak value of the vibration sensor 2 is detected. The angle calculation part 6*h* outputs the crank angle calculation result upon request from the CPU 5 or automatically.

Figure 2:
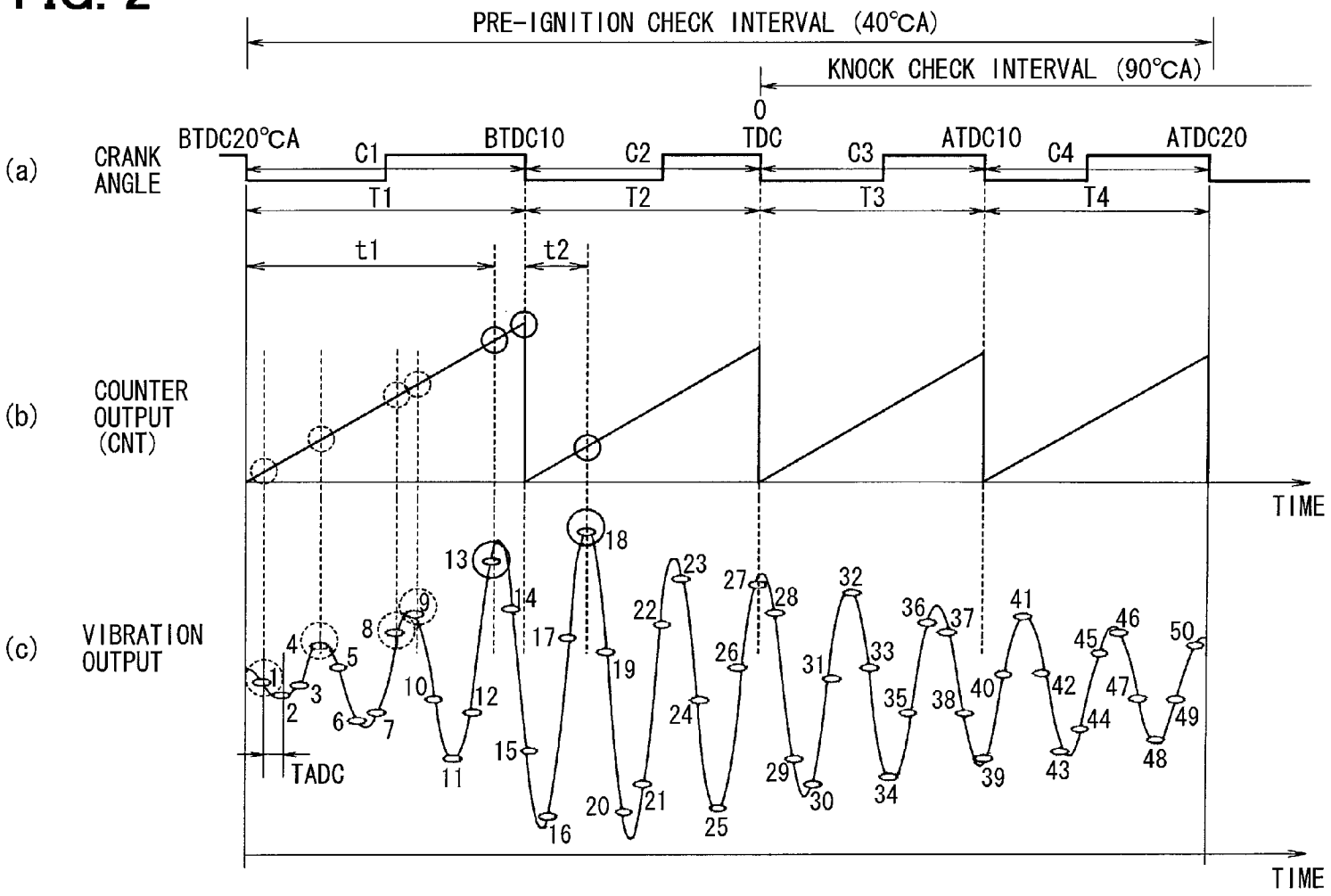
FIG. 2 is a time chart showing signals at various points in the embodiment.

An operation of the embodiment will be described with reference to a waveform chart of FIG. 2 and flowcharts of FIG. 3 and FIG. 4. In FIG. 2, the abscissa axis indicates time. In FIG. 2, (a) to (c) show waveforms of various parts, which are related to signal processing programs shown in FIG. 3 and FIG. 4. In the crank angle (° CA) shown in (a), the top dead center (TDC) is assumed to be 0° CA. A spark ignition in a cylinder normally occurs before the top dead center (BTDC) or after the top dead center (ATDC).

The pre-ignition check interval (interval for checking presence of pre-ignition) is set to be in a range, for example, both before and after 20° CA from the crank angle 0° CA (that is, angular interval of 40° CA from BTDC 20° CA to ATDC 20° CA). In the pre-ignition check interval, as indicated by (a) the crank angle signal, which corresponds to the detection signal of the rotation sensor 3 inputted through the waveform shaper circuit 11, falls at every 10° CA. This interval of crank angle 10° CA is set as a fixed angular interval. The knock check interval is set to a range, for example, from the crank angle 0° CA to 90° CA (that is, angular interval from TDC to ATDC 90° CA).

The counter output in (b) shows a waveform, which resets the counter value CNT of the counter 6*g* at every crank angle 10° CA, that is, angular interval. Since the crank angle depends on a rotation speed of an engine, the counter output value is different immediately before being reset.

The vibration sensor output waveform in (c) shows the detection signal of the vibration sensor 2. Circle marks with numbers indicate timing of the AD conversion processing by the AD conversion circuit 6*a*. In this embodiment, the time interval TADC of the AD conversion is fixed to 10 μs. When the AD conversion output in the present pre-ignition check interval is greater than that in the previous pre-ignition check interval, the present output is stored as the peak value together with the counter output value at that time. For example, in the vibration sensor output waveform (c) shown in FIG. 2, the data at the 1st, 4th, 8th, 9th 13th and 18th AD conversion timings among the 50 AD conversions.

Figure 3:
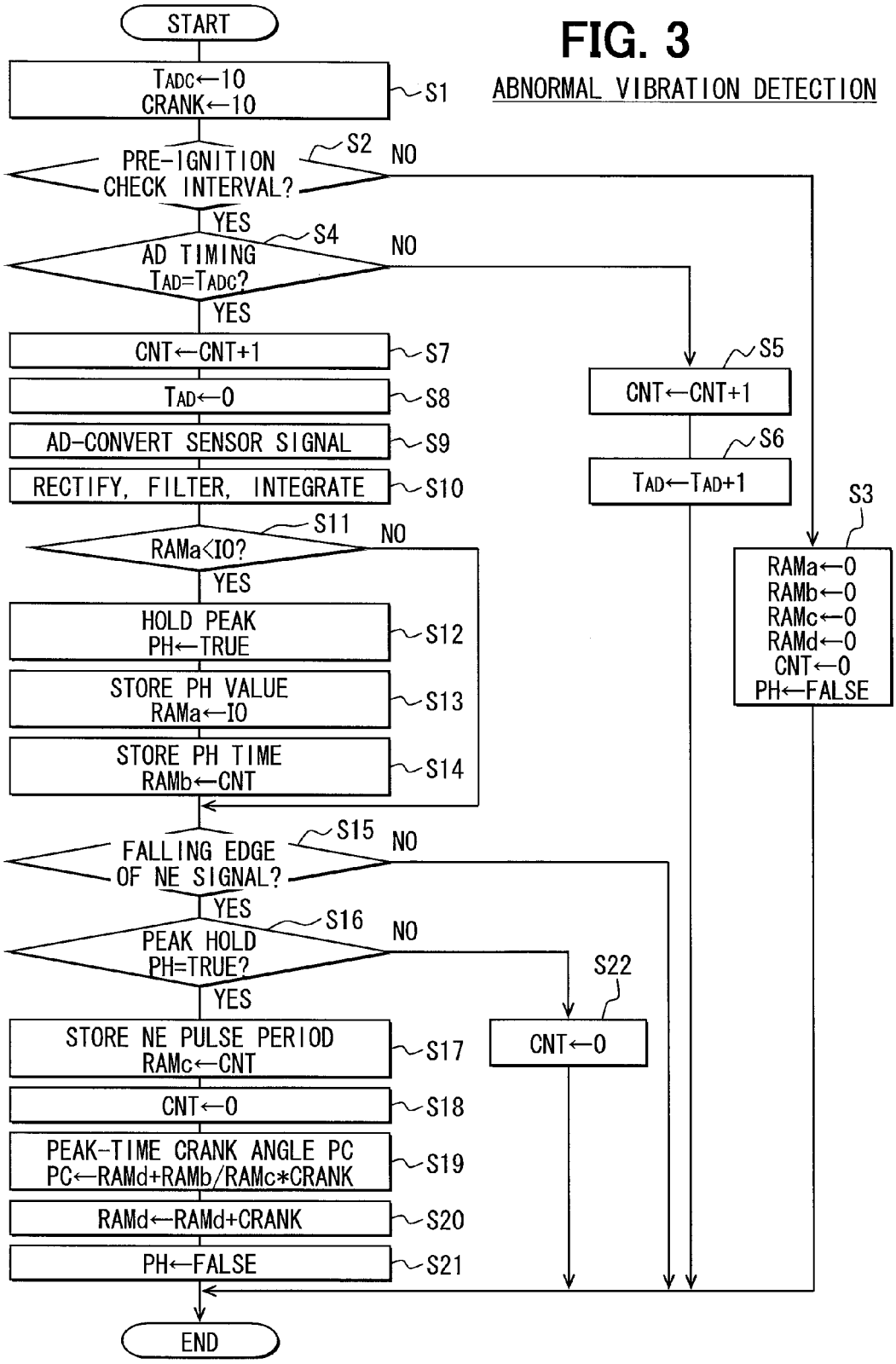
FIG. 3 is a flowchart showing a first part of a sequence of signal processing in the embodiment.
Figure 4:
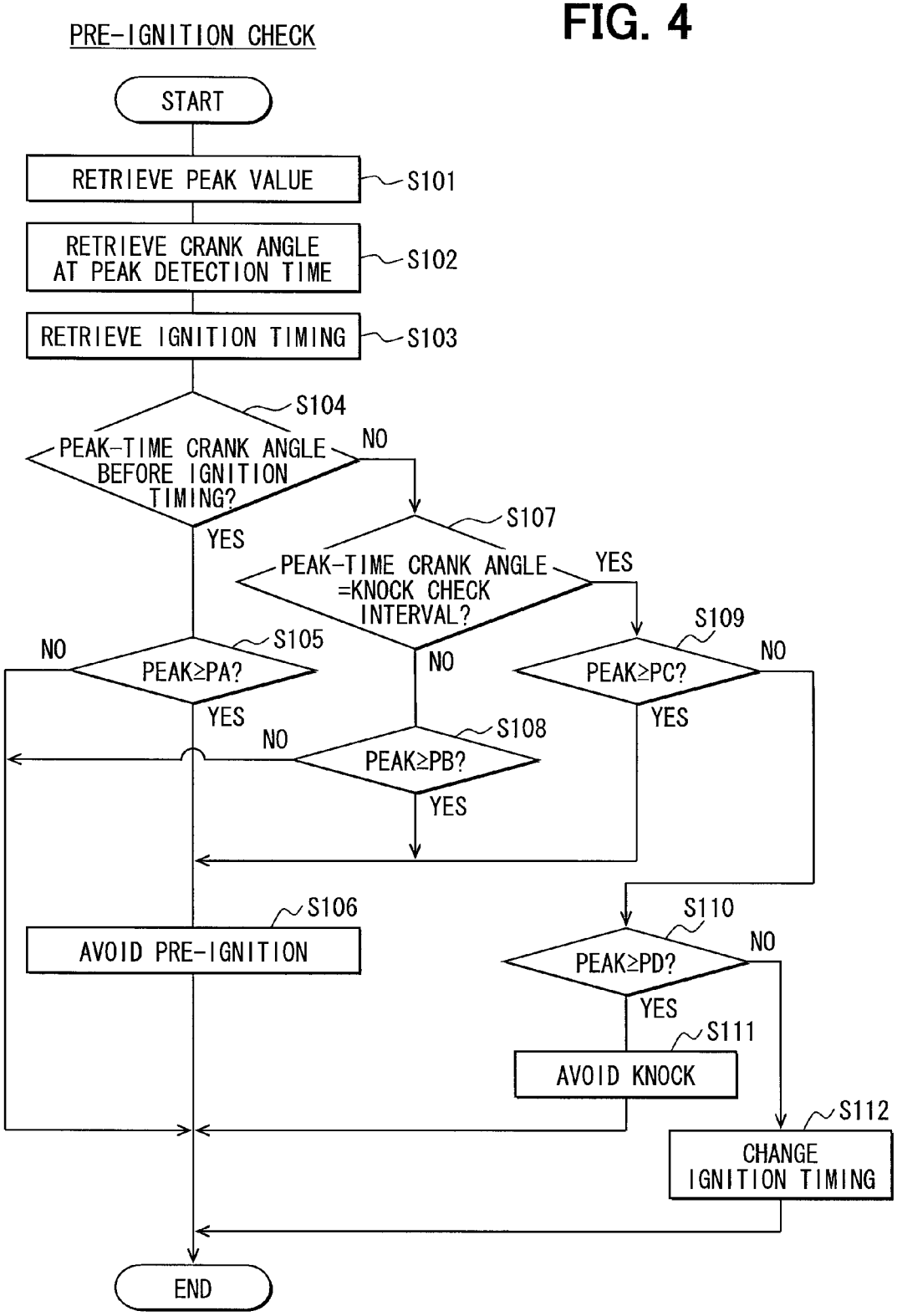
FIG. 4 is a flowchart showing a second part of a sequence of signal processing in the embodiment.

The signal processing is performed as shown in FIG. 3 and FIG. 4. In this example, the 13th AD conversion output is detected as the maximum peak value and updated in the memory area 6*a* of the RAM 6*f* in the crank angle range from BTDC 20° CA to BTDC 10° CA. An elapse time t1 from each start of count operation of the counter 6*g* to this maximum peak time is stored in the memory area Mb of the RAM 6*f* as the counter value.

When the crank angle range from BTDC 20° CA to BTDC 10° CA ends, an elapse time T1 of such an angular interval (10° CA) is stored in the memory area Mc of the RAM 6*f* as the one interval.

Similarly, in the range of next crank angular interval (10° CA) from BTDC 10° CA to TDC, the 18th AD conversion output is detected as the maximum peak value and updated and stored in the memory area Ma of the RAM 6*f*. When the crank angular interval BTDC 10° CA to TDC ends, the elapse time T2 of this angular interval is stored in the memory area Mc of the RAM 6*f* as one interval.

Assuming that the 18th AD conversion output is the maximum peak value in the crank angular interval from BTDC 20° CA to ATDC 20° CA, which is set as the pre-ignition check interval, the peak value data produced at the end of the pre-ignition check interval is the 18th AD conversion output.

In the crank angular interval from TDC to ATDC 10° CA, the knock check processing is also performed in parallel to the pre-ignition check processing. As a result, the peak value detection processing is performed similarly.

In continuing the above-described processing, the CPU 5 of the computer 4 monitors that the crank angle sensor signal of the rotation sensor 3 is inputted from the waveform shaper circuit 11 and confirms that the signal generated in synchronism with the crank angle is outputted normally. Thus reliability of detection operation of the peak value of the sensor signal of the vibration sensor 2 is enhanced.

The abnormal vibration detection is performed by the computer 4 as shown in FIG. 3. It is noted that initial setting processing is executed before this detection processing is executed. In the initial setting processing, the pre-ignition check interval (40° CA) is set and counters, timers and the like are reset. The computer 4 executes this detection processing at every 1 μs.

The computer 4 first sets at S1 a fixed time (AD sampling interval TADC) for AD-converting the sensor signal of the vibration sensor 2 and an angle CRANK of each interval of the rotation sensor 3. Then the computer 4 checks at S2 whether the present crank angle is in the pre-ignition check interval (BTDC 20° CA to ATDC 20° CA). If YES, the vibration detection processing is executed at S4. If NO, S3 is executed, thereby ending this processing. In S3, the memory areas Ma to Md of the RAM 6*f* (indicated as RAMa to RAMd in FIG. 3), the counter value CNT and the peak-hold flag PH are reset (RAMa to RAMd=0, CNT=0, PH=false). As the initial value RAMd of the memory area Md of the RAM 6*f*, a predetermined data corresponding to the BTDC 20° CA, which is the start time of the pre-ignition check interval, is set.

Then the computer 4 executes the detection processing at every 1 μs. When the crankshaft rotation position (crank angle value) enters in the range of the pre-ignition check interval, which is from BTDC 20° CA to ATDC 20° CA during repetition of this detection processing, the check result at S2 becomes YES and the vibration detection processing is executed at S4 and subsequent steps. In the vibration detection processing, the computer 4 checks at S4 whether it is the AD timing by checking whether the AD conversion timer value TAD reached an AD sampling interval TADC, which is a predetermined time value. If the check result at S4 is NO, the counter value CNT and the AD conversion timer value TAD are incremented by one at S5 and S6, respectively.

When the AD conversion timer value TAD reaches a predetermined value 10 of the AD sampling interval TADC, the computer 4 determines YES at S4 and increments the counter value CNT by one at S7. Then the computer 4 clears the AD conversion timer value TAD (TAD=0) at S8. The computer 4 AD-converts the sensor signal, which is inputted from the vibration sensor 2 through the input circuit 9 and the filter circuit 10, by the AD conversion circuit 6*a*, and performs various processing at S10 by the full-wave rectifier circuit 6*b*, the digital filter 6*c* and the integration circuit 6*d*.

Then at S11, the computer 4 checks whether the present integration output IO of the integration circuit 6*d* is greater than a value stored in the memory area Ma of the RAM 6*f*. If YES, the computer 4 determines that the peak-hold is generated. The computer 4 sets a peak-hold generation flag PH to true at S12, and overwrites the integration circuit output IO in the memory area Ma of the ROM 6*f*. The computer 4 overwrites the counter value CNT of the peak hold time in the memory area Mb at S14. Then a falling edge generation check is performed at S15. When the integration circuit output IO is equal to or less than the value previously stored in the memory area Ma of the RAM 6*f*, the computer 4 executes the falling edge generation check processing with respect to the sensor signal (NE) of the rotation sensor 3 at S15.

If the falling edge generation check processing at S15 is YES, the computer 4 checks at S16 whether the peak hold is generated. If NO at S15, the computer 4 ends the processing. If it is determined in the peak hold generation check that the peak hold is generated (PH=true), that is, YES at S16, the computer 4 overwrites the interval of the rotation sensor 3 (counter value CNT at the time of falling of the rotation sensor signal) in the memory area Mc of the RAM 6*f*. This counter value indicates a time interval, for example, T1, T2, T3 or T4, in which the crankshaft completes a rotation of a the angular interval of 20° CA. The computer 4 then resets the counter value CNT (CNT=0) at S18.

Then the computer 4 calculates at S19 the crank angle value PC at the latest peak hold time as follows. Specifically, the computer 4 retrieves the crank angle information stored at the time of falling of the signal of the rotation sensor 3 from the memory area Md of the RAM 6*f*. The computer 4 also retrieves the count value (T), which is the interval of 10° CA until the next crank signal falls, from the memory area Mc of the RAM 6*f*. The computer 4 also retrieves the count value, which is a part of the interval up to the peak hold time, from the memory area Mb. The computer 4 calculates the crank angle data by prorating.

This calculation is expressed as follows assuming that the stored values in the memory areas Mb to Md are RAMb to RAMd.

$$PC=\mathrm{RAM}d+\mathrm{RAM}b/\mathrm{RAM}c\times\mathrm{CRANK}$$

After calculating the crank angle of the peak-held output of the vibration sensor 2, the computer 4 updates the crank angle (RAMd=RAMd+CRANK) at S20 by adding the crank angle value CRANK to the value stored in the memory area Md of the RAM 6*f*. The computer 4 at this time resets the peak hold generation flag (PH=false) and ends the above-described processing.

If the computer 4 determines NO at S16, which checks whether the peak hold is generated, the computer 4 resets the counter value CNT (CNT=0) ay S22 thus ending the processing of FIG. 3.

The computer 4, repeating the above-described abnormal vibration detection processing at every interval of 1 μs, can accurately acquire information indicative of the abnormal vibration output value of the vibration sensor 2 and the crank angle, at which the abnormal vibration is generated. It is thus possible to accurately acquire the peak value data of the vibration sensor 2 at each fall timing of the detection signal of the rotation sensor 3 together with the crank angle data. By repeating this processing, the peak value can be detected in every crank angular interval. One peak value data of the vibration sensor 2 can finally be detected in one pre-ignition check interval (for example, 40° CA). At the same time, the crank angle data at that time can also be detected. In addition, the peak value can be acquired accurately while AD-converting the sensor signal of the vibration sensor 2 at the AD conversion timing of every 10 μs without increasing a memory capacity nor complicating or increasing the signal processing load.

The pre-ignition check processing is performed by the computer 4 as shown in FIG. 4 with respect to the peak value acquired as described above. This pre-ignition processing is executed at every crank angle interval of 10° CA, that is, at every predetermined angular interval, with respect to the peak value acquired by the peak value detection processing (FIG. 3). In the pre-ignition check processing, a pre-ignition threshold value, which is compared with the peak value, is variable to three values.

That is, first, second and third pre-ignition threshold values PA, PB (<PA) and PC (<PB) are provided in the pre-ignition check interval. The first threshold value PA is for a crank angle interval before the ignition timing in the BTDC interval, which corresponds to a former half interval, and does not overlap the knock check interval. The second threshold value PB is less than the first threshold value PA and for a crank angle interval after the ignition timing in the BTDC interval (former half interval). The third threshold value PC is for a crank angle interval, which corresponds to a latter half interval and is the ATDC interval following the TDC. In this latter half interval, the pre-ignition check interval overlaps the knock check interval. The third threshold value PC is greater than the knock threshold value PD.

It is noted that, among the pre-ignition threshold values PA, PB and PC, the threshold value PA used before the ignition timing is a maximum and the threshold value PC is a minimum. This setting is based on that the magnitude of vibration generated by the pre-ignition is the maximum before the ignition timing and then gradually decreases. By thus setting the pre-ignition threshold values differently among the crank angular intervals, pre-ignition can be detected accurately.

The computer 4 retrieves at S101 the peak value, which is acquired by the abnormal vibration detection processing in the angular interval of the pre-ignition check operation, and also at S102 the crank angle of the peak detection time, at which the peak value is detected. The computer 4 then retrieves the ignition timing data from the outside at S103. The computer 4 checks at S104 whether the crank angle (peak-time crank angle) at the peak detection time is before the ignition timing, that is, whether the peak vibration occurred before the ignition. If YES at S104, the computer 4 further checks at S105 whether the peak value is equal to or greater than the first threshold value PA. If YES at S105, the computer 4 performs the pre-ignition avoidance processing at S106 for the next ignition or combustion cycle thus ending the pre-ignition check processing. If NO at S105, no further step is executed. In the pre-ignition avoidance processing at S106, the computer 4 commands to an engine control unit (not shown) to take a conventional pre-ignition avoidance measure, which is for example increase of a fuel injection quantity for enriching air-fuel mixture.

If the crank angle at the time of the peak value detection is after the ignition timing (NO at S104), the computer 4 checks at S107 whether the crank angle at that time is in the knock check interval. At S107, the computer 4 determines NO when the crank angle at the peak value detection time is after the ignition timing and before the knock check interval, that is, before the top dead center TDC. The computer 4 then checks at S108 whether the peak value is equal to or greater than the second threshold value PB. If the peak value is equal to or greater than the threshold value PB (YES at S108), the computer 4 determines that the pre-ignition has occurred and avoids the pre-ignition at S106 as described above. If the check result is NO, no more step is executed.

If YES at S107, that is, the crank angle at the peak value detection time is in the knock check interval and in the overlap interval with the pre-ignition check interval, the computer 4 checks at S109 whether the peak value is equal to or greater than the threshold value PC. If YES at S109, the computer 4 performs the pre-ignition avoidance processing at S106 and ends this pre-ignition check processing.

If NO at S109, that is, the peak value is less than the third threshold value PC, the computer 4 checks at S110 whether the peak value is equal to or greater than the threshold value PD, which is provided for checking knock. The threshold value PD for checking knock is set to be less than the threshold value PC for checking pre-ignition. If YES at S110, the computer 4 performs knock avoidance processing at S111 thus ending the pre-ignition check processing. If NO at S110, that is, the peak value is less than the threshold value PD, the computer 4 changes the ignition timing at S112 thus ending the pre-ignition check processing.

As the knock avoidance processing at S111, the computer 4 commands to the engine control unit a conventional knock avoidance measure such as retarding the ignition timing. At S112 for changing the ignition timing, the computer 4 commands the engine control unit to advance the ignition timing.

The sensor signal processing device according to the present embodiment provides the following features and advantages.

(1) The sensor signal of the vibration sensor 2 is checked to detect the pre-ignition as the abnormal combustion condition. In this operation, the sensor signal of the vibration sensor 2 is converted into the digital signal by the AD conversion circuit 6*a* at every fixed sampling time, for example, 10 μs, in the pre-ignition check interval of the fixed crank angular interval, for example, 40° CA interval from −20° CA to +20° CA. The peak value of the digital signal is detected by the peak hold circuit 6*e*. The crank angle, at which the peak value is detected, is calculated from the count value of the counter 6*g* in the angle calculation part 6*h*. The peak value is compared with the pre-ignition threshold value in each of the crank angular interval by the CPU 5 so that occurrence of the pre-ignition may be checked. Thus, in each pre-ignition check interval provided for one ignition, the pre-ignition is checked in each crank angular interval (10° CA interval). Thus, the storage capacity of the RAM is reduced, and the pre-ignition is checked surely while reducing the number of times of checking. The pre-ignition is checked in each crank angular interval even when the check interval is not over yet. The pre-ignition is detected quickly.

(2) The crank angle at the peak value detection time in each crank angular interval is calculated based on the ratio between the count value of the counter 6*g* and the count value of the interval. The crank angle at the peak value detection time is calculated at each crank angular interval, which is synchronized with the crank angle. The error in the crank angular interval is reduced remarkably. Thus, the crank angle at the peak value detection time is calculated with high accuracy.

(3) The counter 6*g* is reset at a start time of the crank angular interval and the count value, which is counted until the peak value is detected, is acquired as the elapse time. As a result, even when the crank angular interval changes, the elapse time does not increase excessively and the count value is handled without complication.

(4) In comparing the peak value of the sensor signal of the vibration sensor 2 with the pre-ignition threshold value, the pre-ignition threshold value PA and the pre-ignition threshold value PB smaller than the pre-ignition threshold value PA are used, when the crank angle at the peak value detection time is before the ignition timing in the cylinder and after the ignition timing, respectively. Thus it is possible to check the pre-ignition before and after the ignition timing by use of appropriate threshold values.

(5) When the crank angle at the peak value detection time is in a interval, in which the pre-ignition check interval overlaps the knock check interval, the pre-ignition is checked by comparing the peak value with the pre-ignition threshold value PC, which is higher than the knock threshold value PD and lower than the pre-ignition threshold value PB. When the pre-ignition is not determined, the knock check is made by comparing the peak value with the knock threshold value Pd. As a result, both pre-ignition and knock are surely checked even in a crank angle range, in which a plurality of checks is necessitated.

(6) The sensor signal of the vibration sensor 2 is AD-converted by the AD conversion circuit 6*a* at the predetermined sampling interval. Since the AD conversion is performed at every fixed time interval, the digital processing is performed without complicated calculations relative to a case, in which the AD conversion is performed, for example, at every crank angular interval.

(7) The AD conversion circuit 6*a* is configured such that the sampling interval for AD-converting the sensor signal of the vibration sensor 2 is variably settable from an external side. The AD conversion processing is thus performed to match a sensor characteristic or signal property by setting the most suitable sampling interval.

(8) The full-wave rectifier circuit 6*b* is provided for rectifying the full-wave of the sensor signal converted into the digital signal by the AD conversion circuit 6*a*. As a result, data of the negative magnitude is also acquired so that the peak value is detected by more accurately acquiring the sensor signal.

(9) The digital filter 6*c* is provided for removing noises from the digital signal of the sensor signal outputted from the AD conversion circuit 6*a*. As a result, the peak value is detected after removing noise following the AD conversion and more accurate data of the peak value is acquired.

(10) The integration circuit 6*d* is provided for integrating the sensor signal, which is AD-converted into the digital data by the AD conversion circuit 6*a*. By integrating the sensor signal after AD conversion, the integration output is made more free from noise and the peak value is acquired more accurately.

(11) The detection circuit 6, the communication interface circuit 7 and the CPU 5 are integrated into a single semiconductor device. The circuit area is thus reduced in area size and signals are processed speedily due to short travel distance of signals.

(12) It is monitored whether the information about the pre-ignition check interval set in synchronism with the crank angle is being inputted normally. As a result, the peak value of the detection signal of the vibration sensor 2 is detected with high reliability.

(Other Embodiments)

The sensor signal processing device is not limited to the above-described embodiment but may be implemented in various other embodiments, which are exemplified as follows.

In the embodiment, the full-wave rectifier circuit 6*b*, the digital filter circuit 6*c* and the integration circuit 6*d* are provided. However, these circuits may be adopted selectively and all of these circuits may be eliminated.

The vibration sensor 2 is used as a part for detecting the combustion condition, other sensors (for example in-cylinder pressure sensor) may be used for detecting the combustion condition. The rotation sensor 3 is not limited to the type, which outputs the pulse signal. The sensor may be any other types, which output signals synchronized with the crank angle. With respect to the edge of the rotation sensor 3, the crank angular interval may be set at any one of the rising edge and the falling edge.

The timing of crank angle calculation by the angle calculation part 6*h* need not necessarily be synchronized with the timing of peak value detection by the peak hold circuit 6*e*. The crank angle may be calculated at a predetermined timing different from the peak value detection timing. In the check processing shown in FIG. 4, the knock check processing is performed at the same time. The knock check processing may be performed as a different processing program or may be eliminated.

The anti-aliasing filter 9 is provided for removing folding noises relative to the sensor signal of the vibration sensor 2. This circuit is not always necessary and may be eliminated by, for example, AD over-sampling processing. The communication interface 7 is provided between the detection circuit 6 and the CPU 5. However, it may be provided only when necessary. The peak value detection processing is performed by software of the computer 4 having the CPU 5. However it may be performed by hardware such as a logic circuit.

In the peak value detection processing, the pre-ignition check interval is set to the range from BTDC 20° CA to ATDC 20° CA. However, the range may be set to a wider range or a narrower range. The range may also be shifted.

The sampling interval TADC of the AD conversion by the AD conversion circuit 6*a* is set to be 10 μs. However the sampling interval may be set to other time intervals. The crank angular interval CRANK is set to the crank angle 10° CA. This angular interval may be set narrower or wider than 10° CA.

The avoidance processing is performed when the pre-ignition or the knock is determined. However, the avoidance processing may be replaced with alarm or the like. The pre-ignition check processing is performed at every crank angle 10° CA. However, it may be performed at every 20° CA or only once after the pre-ignition check interval (for example, ATDC 20° CA).

The threshold value for checking the pre-ignition is set variably in three stages (three threshold values). However it may be set in two stages (two threshold values) or in only one stage (one threshold value). The time measuring part is configured as the counter 6*g* , which counts elapse time at every fixed time. However it may be configured as a clock, which measures actual time or time interval. The threshold values set as PA>PB>PC>PD may be changed.

What is claimed is:

1. A sensor signal processing device comprising:

an AD conversion part for converting an analog sensor signal outputted from a sensor, which detects a combustion condition in a cylinder of an engine, into a digital signal;

a pre-ignition check interval setting part for setting a pre-ignition check interval in synchronism with a crank angle indicated by a rotation sensor signal, which varies with a rotation of a crankshaft of the engine;

a crank angular interval setting part for setting a plurality of crank angular intervals by dividing the pre-ignition check interval;

a time measuring part for measuring elapse time in the plurality of crank angular intervals;

a peak value detection part for detecting a peak value of the digital signal outputted from the AD conversion part in each of the plurality of crank angular intervals;

a crank angle calculation part for calculating a peak value detection crank angle, at which the peak value is detected in each of the plurality of crank angular intervals, based on the elapse time measured by the time measuring part until the peak value is detected by the peak value detection part; and a memory part for storing the peak value detected by the peak value detection part and the peak value detection crank angle calculated by the crank angle calculation part;

a pre-ignition check part for checking whether a pre-ignition is generated by comparing the peak value detected by the peak value detection part with a pre-ignition threshold value; wherein the pre-ignition check part, in comparing the peak value detected by the peak value detection part with the pre-ignition threshold value, uses as the pre-ignition threshold value, a first pre-ignition threshold value and a second pre-ignition threshold value different form the first pre-ignition threshold value, when the peak value detection crank angle is before an ignition in the cylinder and after the ignition in the cylinder, respectively; and a command part for providing a command, based on the comparing of the peak value with the pre-ignition threshold value, to an engine control unit for controlling an engine parameter.

2. The sensor signal processing device according to claim 1, wherein:

the crank angle calculation part calculates the peak value detection crank angle, at which the peak value is detected in each of the plurality of crank angular intervals, based on a ratio of the elapse time until the peak value is detected relative to a time interval of the crank angular interval.

3. The sensor signal processing device according to claim 1, wherein:

the crank angle calculation part resets the time measuring part at a start time of each crank angular interval and acquires, as the elapse time, a time measured by the time measuring part until the peak value is detected.

4. The sensor signal processing device according to claim 1, wherein:

the pre-ignition check part checks the pre-ignition by comparing the peak value with a third pre-ignition threshold value, which is set higher than a knock threshold value, when the peak detection crank angle is in an interval, in which the pre-ignition check interval overlaps a knock check interval; and the pre-ignition check part checks a knock by comparing the peak value with the knock threshold value, when the pre-ignition is not detected.

5. The sensor signal processing device according to claim 1, wherein:

the AD conversion part is configured to AD-convert the analog sensor signal at a predetermined sampling interval.

6. The sensor signal processing device according to claim 5, wherein:

the predetermined sampling interval is variable externally.

7. The sensor signal processing device according to claim 1, further comprising:

a digital filter for removing noises from the digital signal of the analog sensor signal outputted from the AD conversion part, wherein the peak value detection part inputs the digital signal of the AD conversion part through the digital filter.

8. The sensor signal processing device according to claim 1, further comprising:

an integration circuit for integrating the digital signal outputted by the AD conversion part; and the peak value detection part inputs the digital signal outputted from the AD conversion part through the integration circuit.

9. The sensor signal processing device according to claim 1, further comprising:

a rectification part for full-wave rectifying the digital signal outputted by the AD conversion part, wherein the peak value detection part inputs the digital signal outputted from the AD conversion part through the rectification part.

10. The sensor signal processing device according to claim 1, wherein:

the AD conversion part, the pre-ignition check interval setting part, the angular interval setting part, the time measuring part, the peak value detection part and the crank angle calculation part are integrated into a single semiconductor device.

11. The sensor signal processing device according to claim 1, further comprising:

a monitor part for monitoring whether information about the pre-ignition check interval set in synchronism with the crank angle is being inputted normally.

12. A sensor signal processing device comprising:

an AD conversion part for converting an analog sensor signal outputted from a sensor, which detects a combustion condition in a cylinder of an engine, into a digital signal;

a pre-ignition check interval setting part for setting a pre-ignition check interval in synchronism with a crank angle indicated by a rotation sensor signal, which varies with a rotation of a crankshaft of the engine;

a crank angular interval setting part for setting a plurality of crank angular intervals by dividing the pre-ignition check interval;

a time measuring part for measuring elapse time in the plurality of crank angular intervals;

a peak value detection part for detecting a peak value of the digital signal outputted from the AD conversion part in each of the plurality of crank angular intervals;

a crank angle calculation part for calculating a peak value detection crank angle, at which the peak value is detected in each of the plurality of crank angular intervals, based on the elapse time measured by the time measuring part until the peak value is detected by the peak value detection part;

a memory part for storing the peak value detected by the peak value detection part and the peak value detection crank angle calculated by the crank angle calculation part;

a pre-ignition check part for checking whether a pre-ignition is generated by comparing the peak value detected by the peak value detection part with a pre-ignition threshold value;

the pre-ignition check part checks the pre-ignition by comparing the peak value with a pre-ignition threshold value, which is set higher than a knock threshold value, when the peak detection crank angle is in an interval, in which the pre-ignition check interval overlaps a knock check interval, wherein the pre-ignition check part checks a knock by comparing the peak value with the knock threshold value, when the pre-ignition is not detected; and a command part for providing a command, based on the comparing of the peak value with the pre-ignition threshold value, to an engine control unit for controlling an engine parameter.

13. The sensor signal processing device according to claim 12, wherein:

the crank angle calculation part calculates the peak value detection crank angle, at which the peak value is detected in each of the plurality of crank angular intervals, based on a ratio of the elapse time until the peak value is detected relative to a time interval of the crank angular interval.

14. The sensor signal processing device according to claim 12, wherein:

the crank angle calculation part resets the time measuring part at a start time of each crank angular interval and acquires, as the elapse time, a time measured by the time measuring part until the peak value is detected.

15. The sensor signal processing device according to claim 12, wherein:

the AD conversion part is configured to AD-convert the analog sensor signal at a predetermined sampling interval.

16. The sensor signal processing device according to claim 15, wherein:

the predetermined sampling interval is variable externally.

17. The sensor signal processing device according to claim 12, further comprising:

a digital filter for removing noises from the digital signal of the analog sensor signal outputted from the AD conversion part, wherein the peak value detection part inputs the digital signal of the AD conversion part through the digital filter.

18. The sensor signal processing device according to claim 12, further comprising:

an integration circuit for integrating the digital signal outputted by the AD conversion part; and the peak value detection part inputs the digital signal outputted from the AD conversion part through the integration circuit.

19. The sensor signal processing device according to claim 12, further comprising:

a rectification part for full-wave rectifying the digital signal outputted by the AD conversion part, wherein the peak value detection part inputs the digital signal outputted from the AD conversion part through the rectification part.

20. The sensor signal processing device according to claim 12, wherein:

the AD conversion part, the pre-ignition check interval setting part, the angular interval setting part, the time measuring part, the peak value detection part and the crank angle calculation part are integrated into a single semiconductor device.

21. The sensor signal processing device according to claim 12, further comprising:

a monitor part for monitoring whether information about the pre-ignition check interval set in synchronism with the crank angle is being inputted normally.

* * * * *